United States Patent [19]

Worth

[11] Patent Number: 4,728,299

[45] Date of Patent: Mar. 1, 1988

[54] INSULATION DISPLACEMENT CONNECTOR FOR FLAT CABLE HAVING CLOSELY SPACED WIRES

[75] Inventor: Sidney V. Worth, Flourtown, Pa.

[73] Assignee: Continental-Wirt Electronics Corporation, Southampton, Pa.

[21] Appl. No.: 942,928

[22] Filed: Dec. 22, 1986

Related U.S. Application Data

[63] Continuation of Ser. No. 770,064, Aug. 28, 1985, abandoned.

[51] Int. Cl.[4] ..... H01R 4/24; H01R 9/11

[52] U.S. Cl. ..... 439/405

[58] Field of Search ..... 399/99 R, 97 R, 97 P, 399/98; 439/391–408, 409, 410, 417, 418, 422, 425, 442–444

[56] References Cited

U.S. PATENT DOCUMENTS

| | | | |
|---|---|---|---|
| 4,106,838 | 8/1978 | Jayne et al. | 339/99 R |
| 4,114,975 | 9/1978 | Weidler | 339/176 M |
| 4,156,553 | 5/1979 | Ammon et al. | 339/176 M |
| 4,310,208 | 1/1982 | Webster et al. | 339/97 P |
| 4,466,684 | 8/1984 | Grant et al. | 339/176 M |
| 4,475,786 | 10/1984 | Root et al. | 339/99 R |
| 4,487,471 | 12/1984 | Freshwater et al. | 339/99 R |
| 4,504,102 | 3/1985 | Wakuluk | 339/99 R |
| 4,512,621 | 4/1985 | Bethurum | 339/99 R |

FOREIGN PATENT DOCUMENTS

| | | | |
|---|---|---|---|
| 0014037 | 8/1980 | European Pat. Off. | 339/97 P |
| 0039978 | 11/1981 | European Pat. Off. | 339/99 R |
| 0009886 | 1/1977 | Japan | 339/97 R |
| 2076601 | 12/1981 | United Kingdom | 339/98 |

*Primary Examiner*—Gil Weidenfeld
*Assistant Examiner*—Gary F. Paumen
*Attorney, Agent, or Firm*—Caesar, Rivise, Bernstein, Cohen & Pokotilow, Ltd.

[57] ABSTRACT

An insulation displacement connector for flat multiconductor cable has a housing containing several, and preferably three, rows of openings on centers of 0.100 inch. The rows of openings are laterally aligned to each other so that aligned contact pins of a header may be inserted into the openings. Identical contacts are contained in each of the openings. The contacts contain wire piercing ends or tines which are laterally displaced from the center line of the contacts. The contacts are inserted into the openings with the contact tines displaced in one direction in a first row of contacts and in an opposite direction, such as 180°, on a second row of contacts. The lateral displacement between the centers of the contact tines from the center of the respective contact is equal to one-half of the spacing between the wires of the multiconductor cable. Further contacts are inserted into the openings in a third row of contacts and are oriented identically to the contacts in the second row but are laterally displaced therefrom by the spacing between the wires of the multiconductor cable. By the present arrangement of the contacts, all the wires of a multiconductor cable with 0.033 inch spacing between wires are engaged by the connector, while still using identical contacts.

9 Claims, 13 Drawing Figures

INSULATION DISPLACEMENT CONNECTOR FOR FLAT CABLE HAVING CLOSELY SPACED WIRES

This is a continuation of Ser. No. 770,064, filed Aug. 28, 1985, now abandoned.

BACKGROUND OF THE INVENTION

This invention relates to insulation displacement connectors, and more specifically relates to insulation displacement connectors which can make connection to the wires of flat multiwire cable which are very closely spaced, for example by 0.033 inch.

Insulation displacement connectors are known for making connection to flat multiwire cable. The usual contact orientation in a header and/or a mating socket is 30 contacts on two rows making a 60 contact connector; or 25 contacts on each of two rows making a 50 conductor connector; or 2 rows of 13 contacts making a 26 contact header and/or connector.

Commonly, insulation displacement connectors can engage wires spaced from one another within the cable by about 0.50 inch. If, however, the wires are even more closely spaced, it is difficult to provide a connector which is relatively inexpensive since the individual connector contacts have different geometries.

In accordance with one aspect of the present invention, a third row of contacts is added so that a 60 conductor header and/or socket has 3 rows of 20 contacts. A 24 contact device would have 3 rows of 8 contacts. To accomplish this, a novel single contact is employed. The novel contact of the invention uses one and the same physically shaped contact to connect electrically and mechanically from conductors on 0.033 inch centers to electrical contacts on 0.100 inch centers. Single contact usable in all positions consists of an IDC tail that interfaces with cable conductors on 0.033 inch centers; noses whose centers are spaced 0.033 inch from each other; and a metal conductor connecting each end. The center line of one nose shares the same center line as IDC tail. The other nose center line is offset by 0.033 inch from center line of IDC tail. Consequently, contact can be made to multi-cable wires as closely spaced as 0.033 inch, while using identical contacts for the insulation displacement connector.

More particularly, in accordance with the invention, the novel contact structure has a contact insulation piercing end which is laterally displaced from the lateral central line of the contact by a distance equal to one-half the distance between adjacent wires in the multicable conductor. By then using the same contact, but rotating the contacts of adjacent rows of contacts which are vertically aligned relative to one another, the contact insulation piercing ends of the contacts will be displaced by the requisite distance to engage adjacent wires in the cable.

The so-called nose ends of the contact, which are the ends which engage the pins of headers, extend through the housing of the connector and terminate at a location where they can slidingly engage the pins of a conventional header. The nose ends of the contacts are bowed springs which are disposed in a generally flat plane which is generally coplanar with the plane of the contact tine. The nose ends are sufficiently wide that they will engage the header pin at the header pin location regardless of the angular position of the contact within the housing. The header pin engages one lateral side of nose end where the contact has one angular orientation. Pins of other rows can engage the other lateral side of the contacts of that row. Preferably, the nose end is bifurcated into two legs to ensure a high-pressure contact from one of the legs to a header pin regardless of the lateral position of the header pin with respect to the contact nose.

A third row of contacts is preferably provided where the openings in the housing for the third row of contacts are laterally displaced from the other openings by the distance of the spacing between adjacent wires in the cable which is to be received by the insulation displacement connector. The insulation piercing ends of each of the contacts of each of the three rows of the insulation displacement header will then be spaced from one another by the spacing of the wires along the full length of the header to place a wire piercing end of a contact in alignment with each wire of a header. The nose end of the contacts in the third row is operable to receive a plug-in contact which is in line with the contacts of two upper rows. Thus, one lateral row of plug-in contacts can connect to three cable conductors spaced from one another by 0.033 inch. A second line of three plug-in contacts are connected to the next three cable conductors, also spaced from one another by 0.033 inch.

DETAILED DESCRIPTION OF THE DRAWINGS

Figure 2:
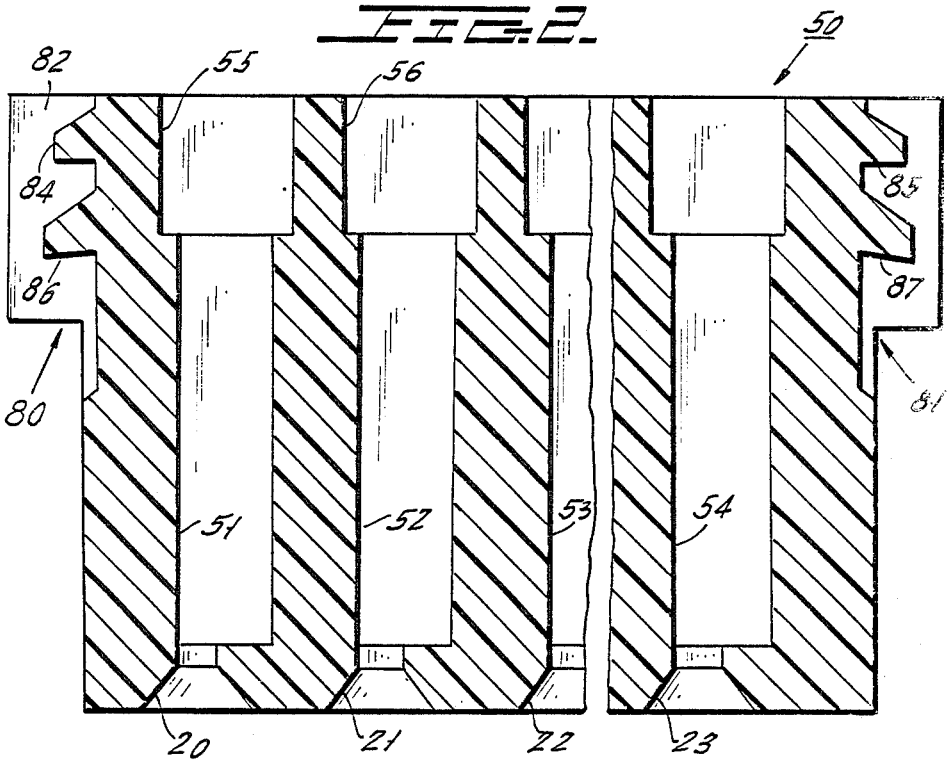
FIG. 2 is a cross-sectional view of FIG. 1 taken across the section line 2—2 in FIG. 1.
Figure 1:
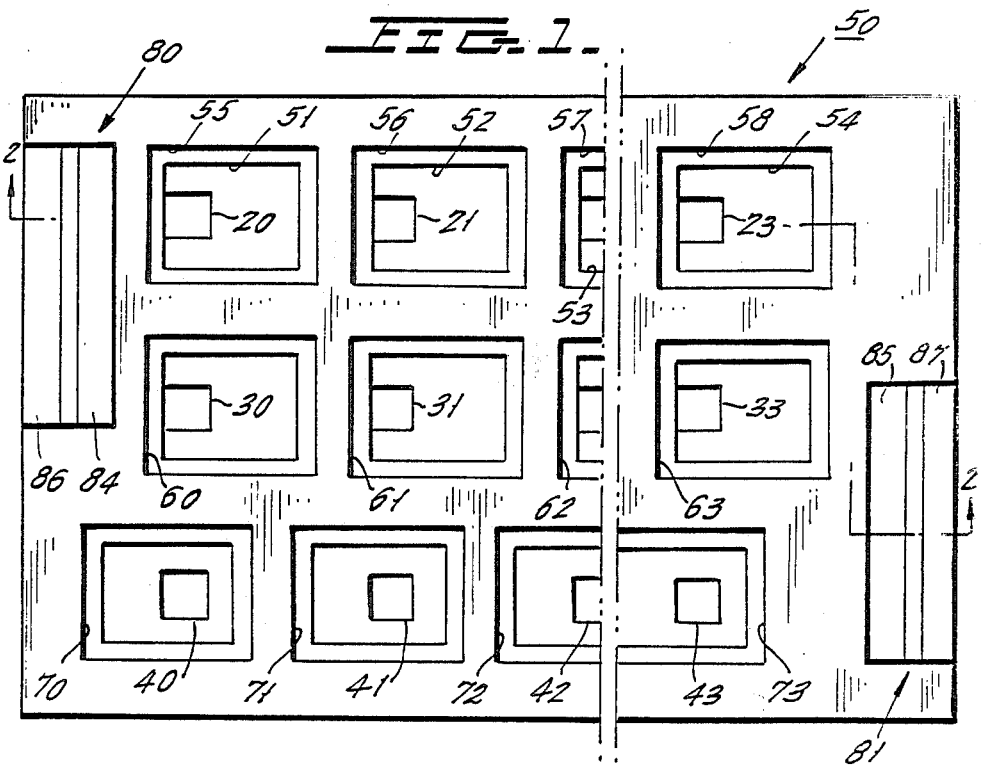
FIG. 1 is a top view of the housing of the insulation displacement connector of the invention.
Figure 3:
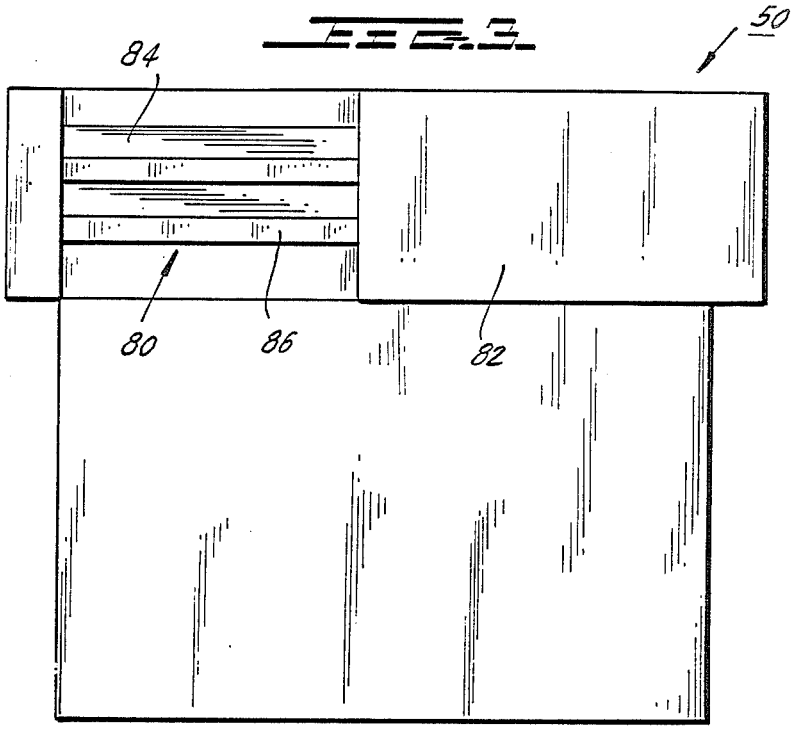
FIG. 3 is a side view of the left-hand side of FIGS. 1 and 2.
Figure 4:
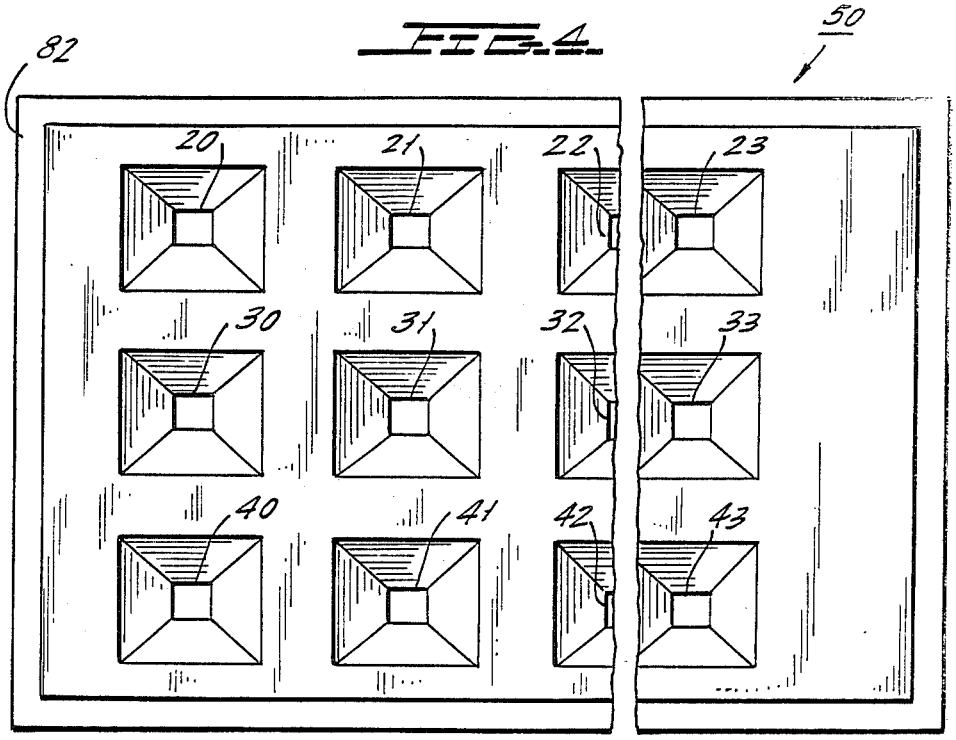
FIG. 4 is a bottom view of FIG. 1.

Referring first to FIGS. 1–4, there is shown therein the base insulator or housing 50 which may be of any desired insulation material for the connector of the invention. The base insulator 50 contains three rows of openings for receiving the pins of a standard header (not shown) in which the pins are on centers spaced by 0.100 inch in a plurality of aligned rows. The bottom openings of the base insulator 50, which are regularly and orthogonally arranged, are shown in FIG. 4 and include openings 20, 21, 22 and 23 (also shown in FIG. 2) in a first row; similar openings 30–33 in a second row; and similar openings 40–43 in a third row. Each of these openings leads to a respective elongated opening through the housing body, shown in FIG. 2 as elongated openings or channels 51–54 which align with openings 20–23, respectively.

These openings extend to the upper surface of the housing 50. Thus, openings 51–54 terminate in enlarged opening regions 55, 56, 57 and 58, respectively. The other two rows of openings through the housing terminate on the upper surface of the housing at openings 60, 61, 62 and 63 (FIG. 1) for the second row of openings and openings 70, 71, 72 and 73 for the third row of openings. Openings 20, 39 and 40 are vertically aligned; openings 21, 32 and 41 are vertically aligned; openings 22, 32, and 42 are vertically aligned; and openings 23, 33 and 43 are vertically aligned.

The housing 50 of FIGS. 1–4 also contains a pair of offset locking ears 80 and 81 which are disposed within a surrounding shelf 82. The locking ears 80 and 81 consist of protrusions 84 and 85 which will loosely lock a cover onto the housing in an "upper", or still open, cover position, as will be later described. Second protrusions 86 and 87 are beneath protrusions 84 and 85, respectively, and are used to lock the cover tightly in place. Note that protrusions 86 and 87 have a greater length than the loose locking protrusions 84 and 85.

Figure 5:
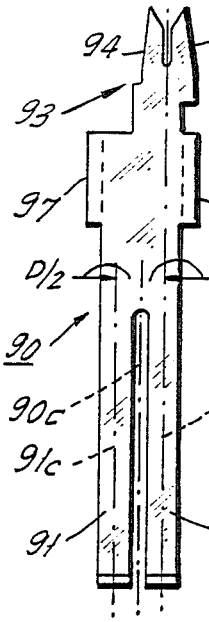
FIG. 5 is a side elevation view of the novel contact of the present invention.
Figure 6:
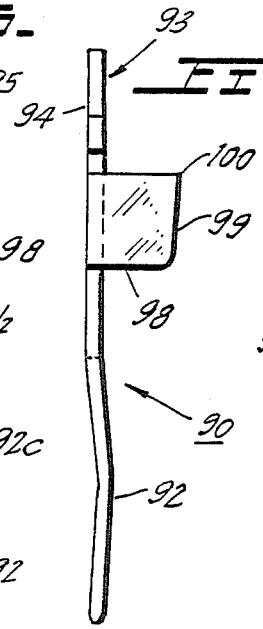
FIG. 6 is a front view of FIG. 5.
Figure 7:
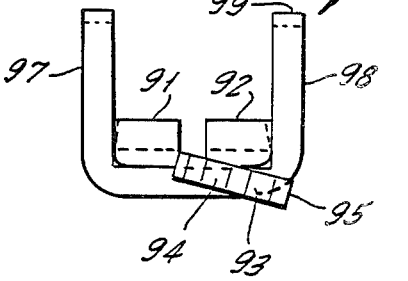
FIG. 7 is a top view of FIGS. 5 and 6.

Referring next to FIGS. 5, 6 and 7, there is shown therein the contact 90 which is loaded into each of the openings in the housing 50. The contact preferably consists of a beryllium copper, or the like, or of any conventional plated or unplated contact material used for contacts of insulation displacement connectors. The contact 90 of FIGS. 5, 6 and 7 may be a stamping which may have a thickness of about 0.008 inch. Contact 90 has a nose end formed of the bifurcated legs 91 and 92 which may be bowed out of a straight line as shown in FIG. 6. Each contact also contains a piercing tine end 93 formed of two spaced barbs 94 and 95 which are spaced by a slot. The slot is a wire receiving channel to receive and contact the wire of a flat insulated cable after the barbs 94 and 95 pierce the cable insulation, straddling the wire to be received within the slot. The piercing tine 93 is preferably twisted to an angle between 3° and 5°, as shown in FIG. 7.

The contact 90 has a lateral center line defined by the center line 90*c* of the slot between legs 91 and 92. The center line 92*c* of leg 92 is preferably aligned with the center line of the slot between barbs 94 and 95 as illustrated, and thus are both referenced herein by the same numeral 92*c*. The center line 92*c* of the slot between barbs 94 and 95 is laterally displaced from the center line 90*c* between legs 91 and 92 by D/2, a distance approximately equal to one-half of the spacing D between the wires in the flat cable which is to be connected to the insulation displacement connector of the invention. Additionally, in the illustrated embodiment of the contact 90, the center line 92*c* of the slot between barbs 94 and 95 is laterally spaced by distance D from the center line 91*c* of the leg 91. By way of example, where the spacing D between wires is 0.033 inch, the spacing between the lateral center line 90*c* of the contact and the center line 92*c* of the slot between the barbs is one-half of 0.033 inch.

The contact of FIGS. 5, 6, and 7 also contains locating and locking arms 97 and 98 which are integral extensions of the stamping which forms the contact 90. To assist in the loading and locking of the contacts within the openings in the insulation housing 50 of FIGS. 1–4, the edge surface 99 of arm 98 (FIGS. 6 and 7) is tapered inwardly slightly to define a locking barb 100 at its upper edge. This locking barb will bite into the plastic material within the opening, such as opening 51 shown in FIG. 13, which will be later described, thereby holding the contact in position after it has been inserted in its respective opening in the housing 50. A similar taper is provided for arm 97.

Figure 8:
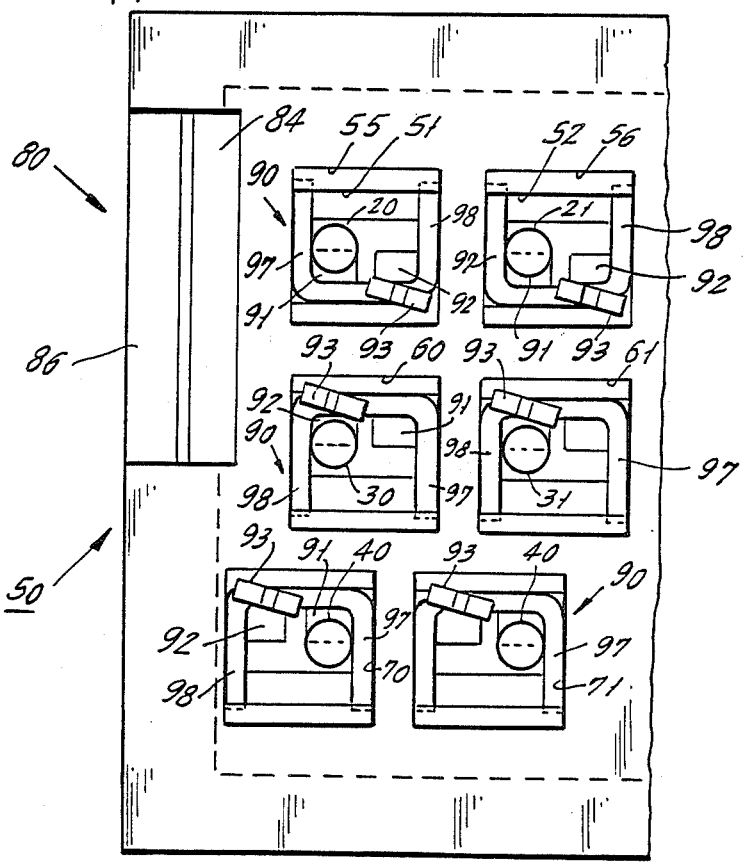
FIG. 8 is a top view of a portion of the housing of FIG. 1, with contacts of the structure of FIGS. 5, 6 and 7 installed in the openings in the housing.

FIG. 8 shows contacts 90 of FIGS. 5, 6, and 7 inserted into the housing openings in accordance with the present invention. In the upper row, contacts 90 are inserted with the arms 97 and 98 facing upwardly so that the tines 93 are disposed toward the right of the openings 20, 21 wherein header pins (not shown) are inserted. Note that when inserting the contacts 90, the ledges such as the ledge defined between openings 51 and 55, serve as a seat to receive extending arms 97 and 98 of the contact, thereby to properly locate the contact within the housing 50.

In the second row of openings, including openings 60 and 61, the contact 90 is rotated 180° from the position it occupies in the first row of openings 55 and 56. Thus, the arms 97 and 98 point downwardly. This repositioning of the contacts 90 causes the tines 93 of the contacts 90 in opening 60 and 61 to be spaced from the tines 93 in the opening 55 and 56 by a distance equal to the spacing between the adjacent wires of the flat conductor to which contact is to be made, while the header pin openings 20, 30 and 21, 31 are respectively aligned with each other. Thus, extremely close spacings can be accommodated, even though the same contact is to be used. It will be later shown that invention also enables connection to conventional header pins which enter openings in the bottom of the housing 50.

The contacts 90 which are assembled into openings 70 and 71 in the lower row of contacts in FIG. 8, are disposed like the contacts in the middle row and have the projecting arms 97 and 98 pointing downwardly. However, openings 70 and 71, but not openings 40, 40, are displaced to the left from openings 60 and 61 by a distance equal to the wire spacing between the wires in the cable to be connected to the tines 93 of the contacts in openings 60 and 70. Therefore, the tines of the contacts in the bottom two rows will be displaced by this same distance. Consequently, as viewed from left to right along the header of FIG. 8, it will be observed that each of the tines 93 in openings 70, 60 and 55 is spaced from one another by the spacing between the wires in the cable to which connection is to be made. Similarly, the tine 93 of the contact in bottom opening 71 is spaced by this same critical distance from the tine 93 in opening 55 in the upper row of contacts. Thus, the tine 93 is presented at a continually equal spacing along the length of the header to make contact to every wire in the multicable conductor, even though these wires are very close together.

In addition to accomplishing this important result, it will be noted that it is accomplished while retaining the regular header pin pattern for a header pin which will have pin locations as shown in the geometrical array of FIG. 4. This is accomplished since the header pin will engage one or the other of legs 91 or 92 of the contact nose end depending on the orientation of contact 90. More specifically, considering the contact in opening 55 of FIG. 8, it will be seen that a pin coming through opening 20 will make sliding contact with nose end leg 91. The pin coming through opening 30 will contact nose end leg 92. Finally, the pin coming through opening 40 in the bottom row will contact nose end leg 91. Note that these contact nose ends are bowed sufficiently that they will extend slightly beyond the center of the opening in which they are received so that sufficient contact pressure is made to the pin entering the housing opening.

Figure 10:
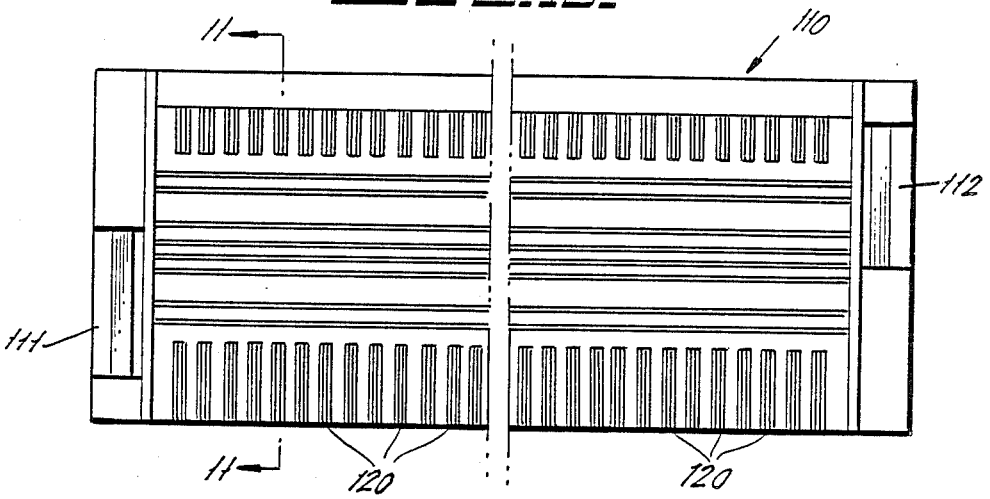
FIG. 10 is a bottom view of the insulation housing cover of FIG. 9.
Figure 9:
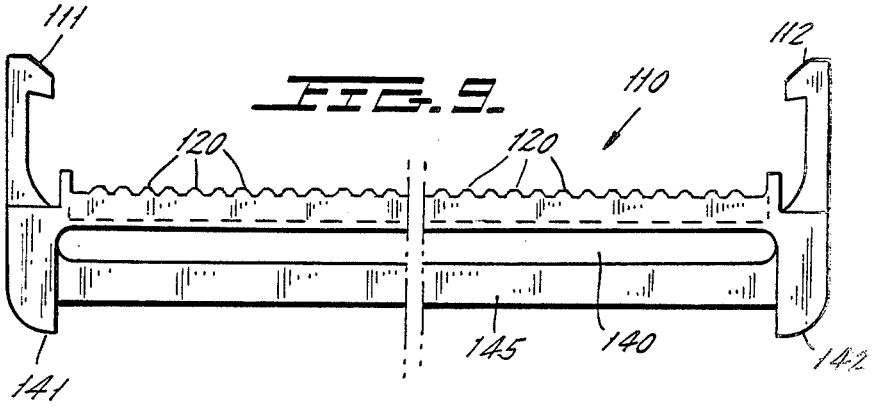
FIG. 9 is a front view of the insulation housing cover.
Figure 11:
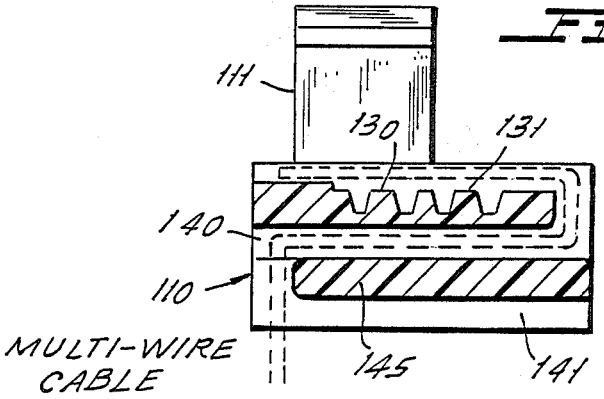
FIG. 11 is a cross-sectional view of FIG. 10 taken across the section line 11—11 in FIG. 10.

A cover member 110 is provided having the configuration shown in FIGS. 9, 10 and 11 for covering the connector housing. Cover 110 is formed of an integral injection molded part of insulation plastic and has two flexible arms 111 and 112 which are operable to latch over the latch receiving members 84–85 of the housing (FIG. 2) in an "upper" position in which a suitable cable may be inserted between the tines 93 of contacts 90 and the cover 110. The flexible arms are further operable to latch receiving members 86–87 of the housing (FIG. 2) in a "lower" or fully closed position after the tines 93 have been fixed to a cable. Cover 110 is further provided with a plurality of ribs, such as ribs 120, which are spaced by the distance of the wires within the cable to be received and are disposed between the wires and help press them against the surface of the housing after the cable is in place and the cover is locked onto the housing. The underside of the cover may also contain slots, such as slots 130 and 131 to provide relief at the regions at which the tine ends 93 of contacts 90 penetrate the multiconductor cable.

Cover 110 contains a through-opening 140 through which the cable may be threaded. Cover 110 may also have a pair of projections 141 and 142 which define a platform 145 between them over which the cable can wrap and lie after being threaded through the opening 140, and which also serves as a strain relief member.

Figure 12:
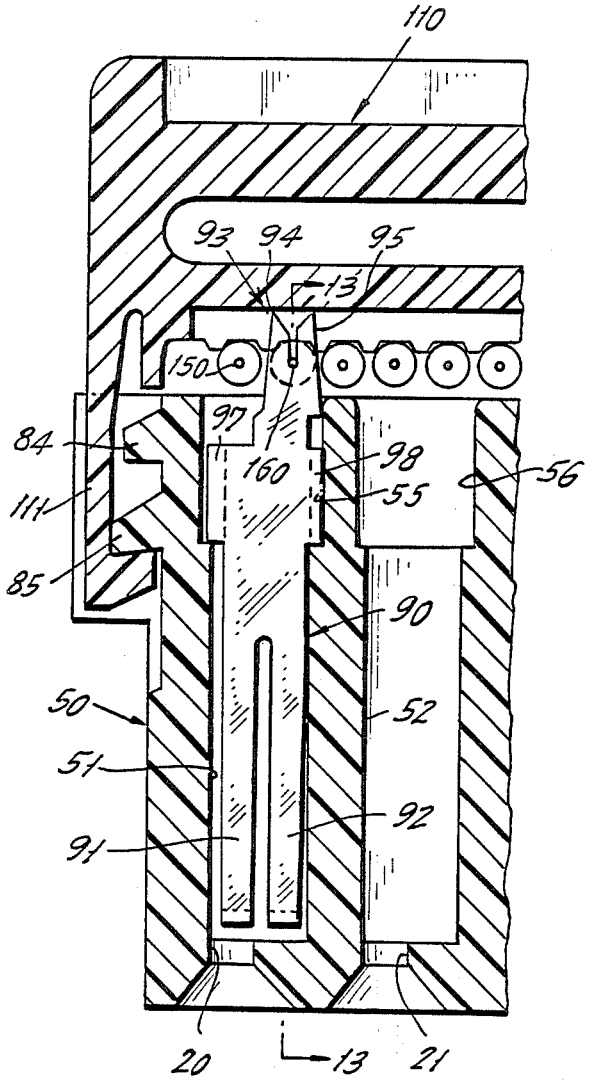
FIG. 12 is a cross-sectional view of a portion of the housing of FIG. 2 with contacts of FIG. 5 and the cover of FIG. 9 in position.
Figure 13:
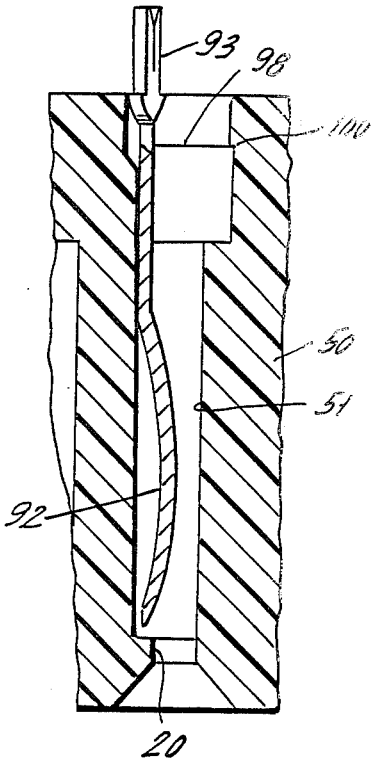
FIG. 13 is a cross-sectional view of FIG. 12 taken across the section line 13—13 in FIG. 12 with the cover removed.

FIGS. 12 and 13 show one end of the cable assembly with a single one of the contacts 90 in position, as was previously described, and with the cover 110 in place. Note that there is also schematically illustrated insulated conductive wires which are a portion of a conventional flat multiconductor cable. Thus, wires 150 and 160 are spaced, for example, by 0.033 inch. Wire 160 is conductively received in the slot between the barbs 94 and 95 which penetrate the insulation sheathing (not shown) of the cable. Each of the other wires will be received by a similar contact tine of a different row in sets of three when three rows of contacts are employed. Note that any number of rows of contacts can be employed while carrying out the present invention.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. An insulation displacement connector for a flat flexible multi-conductor cable; said multi-conductor cable comprising a plurality of wires laterally spaced from one another by a first distance and contained within a flexible insulation sheath, said connector comprising an insulation housing which contains a plurality of openings arranged in at least three parallel rows, each of said rows having at least two openings, each of said openings containing one of a plurality of identical electrical contacts; each of said contacts being of a fixed size and configuration and comprising an insulation piercing end and an oppositely disposed nose end, each of said piercing ends comprising a slot portion and being operable to pierce the insulation sheath of said multi-conductor cable, whereupon said slot portion electrically engages a respective one of said plurality of wires; each of said plurality of openings being operable to receive a respective pin of a multi-pin header to be connected to said connector, said pins being arranged in at least three rows having at least two pins per row and spaced apart by a second distance larger than said first distance; each of said contacts having a lateral center line, with the slot portion of each contact being offset from the contact's lateral center line by a distance equal to one-half of said first distance; each of said nose ends of said contacts including first and second pin engaging portions, said first and second pin engaging portions of each contact being located on opposite sides of said center line and spaced therefrom by a distance equal to one-half of said first distance, and with said second pin engaging portion of each contact being axially aligned with the slot portion thereof; said contacts being disposed so that each contact in one row is located in a respective opening therein and oriented in a first common direction and manner, with its respective first pin engaging portion axially aligned with the header pin to be received in said respective opening, each contact in a second row is located in a respective opening and oriented in a second common direction and manner, with its second pin engaging portion axially aligned with the header pin to be received in said respective opening, and each contact in a third row is located in a respective opening and oriented in a third common direction and manner, with its first pin engaging portion axially aligned with the header pin to be received in said respective opening, the center lines of corresponding contacts of said first and second rows being aligned while the center lines of the corresponding contacts of said third row are offset from said aligned center lines by said first distance, whereupon when said header is connected to said connector, some of the pins of said header engage some of the first pin engaging portions of the associated contacts in good electrical continuity while some of the pins of the header engage some of the second pin engaging portions of the associated contacts in good electrical continuity therewith.

2. The connector of claim 1 wherein said second distance is three times said first distance.

3. The connector of claim 1 wherein each of said openings includes a ledge therein and wherein the nose end of each of said contacts is received atop the ledge in its respective opening.

4. The connector of claim 1 wherein first and second pin engaging portions of each of said contacts comprising a respective arm, said arms being separated from each other by a slot therebetween.

5. The connector of claim 4 wherein each of said arms is bowed.

6. The connector of claim 1 wherein said piercing end of said contact is generally disposed in a plane and wherein said nose end of said contact is generally disposed in said plane.

7. The connector of claim 6 wherein first and second pin engaging portions of each of said contacts comprising a respective arm, said arms being separated from each other by a slot therebetween.

8. The connector of claim 7 wherein each of said arms is bowed.

9. The connector of claim 2 wherein said first distance is 0.033 inch and wherein said second distance is 0.100 inch.

* * * * *